United States Patent [19]

Juillard

[11] Patent Number: 4,478,257

[45] Date of Patent: Oct. 23, 1984

[54] DEVICE FOR REGULATING THE TENSION OF WARP THREADS IN A WEAVING LOOM

[75] Inventor: Yves Juillard, Mulhouse, France

[73] Assignee: Societe Alsacienne de Construction de Materiel Textile, France

[21] Appl. No.: 448,411

[22] Filed: Dec. 9, 1982

[30] Foreign Application Priority Data

Dec. 23, 1981 [FR] France ..... 81 24098

[51] Int. Cl.[3] ..... D03D 49/06

[52] U.S. Cl. ..... 139/110; 66/211

[58] Field of Search ..... 139/100, 110, 109, 103, 139/114; 66/211, 213

[56] References Cited

U.S. PATENT DOCUMENTS

| | | | |
|---|---|---|---|
| 2,914,093 | 11/1959 | Anderson et al. | 139/110 |
| 3,156,267 | 11/1964 | Hooper | 139/110 |

FOREIGN PATENT DOCUMENTS

| | | | |
|---|---|---|---|
| 3106673 | 12/1981 | Fed. Rep. of Germany | 139/110 |
| 48-23108 | 7/1973 | Japan | 139/110 |
| 699048 | 11/1979 | U.S.S.R. | 139/110 |
| 765420 | 9/1980 | U.S.S.R. | 139/114 |

*Primary Examiner*—James Kee Chi

*Attorney, Agent, or Firm*—George H. Gerstman

[57] ABSTRACT

A regulating device for actuating the regulating element of the speed-changing unit of a warp-beam let-off motion as a function of the position of a lever of the balance for measuring the tension of warp threads. A jamming member is engaged over a bar which is driven in reciprocating motion by an eccentric. The jamming member is capable of selective sliding along the bar or jamming against said bar according to the orientation given to the jamming member by a rod attached to the balance lever. The energy required for regulating the speed-changing unit is supplied by a shaft which is driven by the main motor of the loom and drives the bar in reciprocating motion.

15 Claims, 11 Drawing Figures

FIG. 5
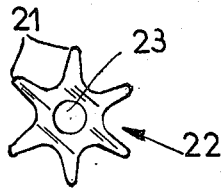
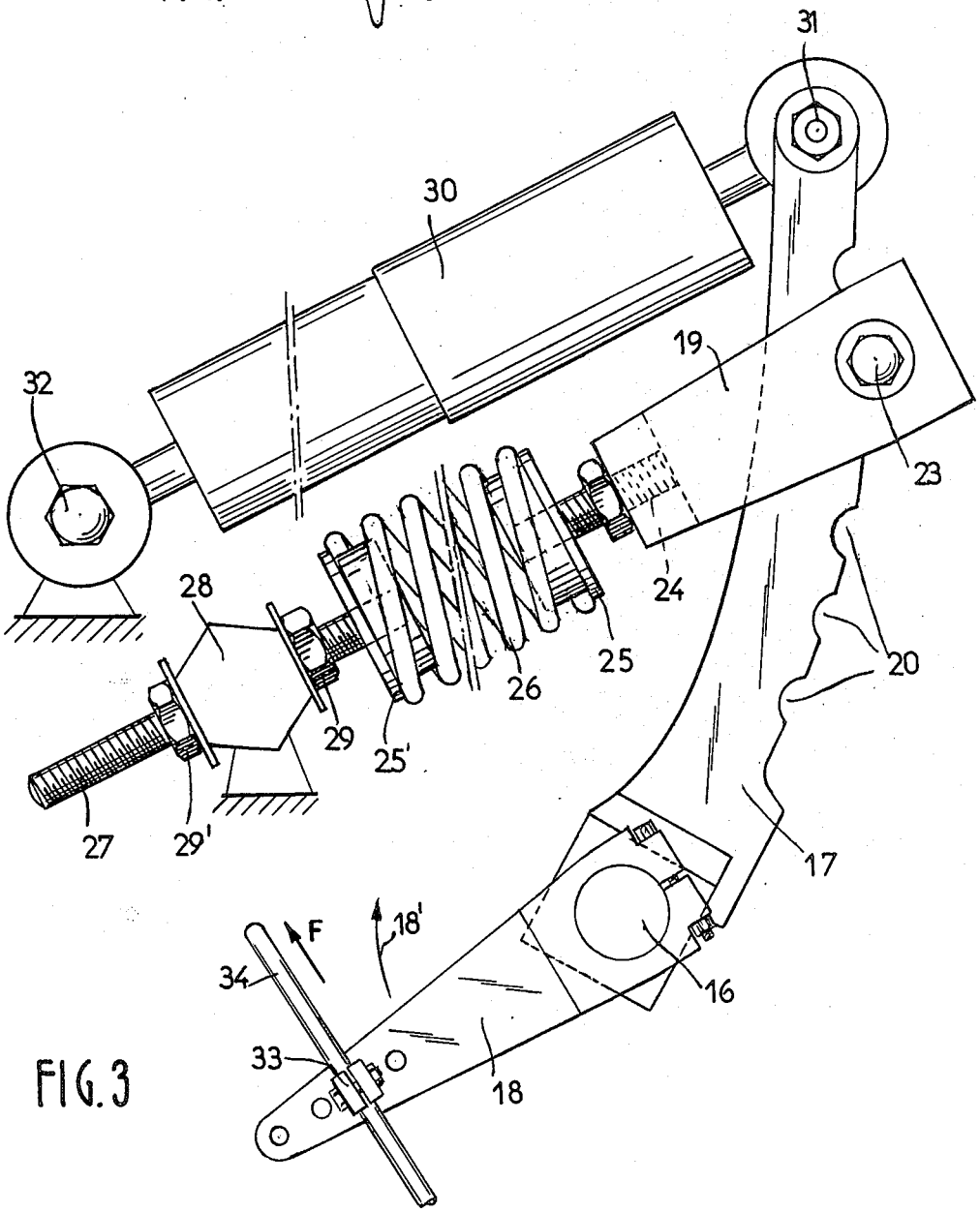
FIG. 3

DEVICE FOR REGULATING THE TENSION OF WARP THREADS IN A WEAVING LOOM

This invention relates to an assisted mechanical control device for actuating a controlled element in dependence on the displacements of a movable sensing element. The invention is more particularly concerned with the textile industry in which a device of this type is employed for regulating the tension of warp threads in a weaving loom.

In this case, the above-mentioned controlled element is the regulating element of a speed-changing unit in the warp-beam let-off motion of a weaving loom whilst the above-mentioned movable sensing element is constituted by one of the members of the balance for measuring the tension of the warp threads.

The general principles of operation of a weaving loom and of the devices for regulating the tension of warp threads are well-known to those versed in the art but will first be recalled in brief outline.

The threads which constitute the warp of the fabric are wound side by side on a warp beam. On the delivery side of the beam, the warp threads bear on a tension roller, are then drawn individually through the heddle eyes carried by the frames which are driven in a vertical reciprocating movement under the action of the shedding mechanism. On completion of the drawing-in operation, the warp threads are divided into two layers in order to form the shed in which the weft threads are inserted. The movement of the heddle frames has the effect of crossing the two layers according to the construction of the fabric which is being woven. Each weft pick is beaten-up against the fell of the cloth by the reed which is driven in back-and-forth motion under the action of the loom slay. The fabric is progressively delivered under the action of the take-up roller and is wound onto the cloth beam in the known manner.

Let-off or unwinding of the warp threads is positively controlled but the length of yarn released as a result of rotation of the warp beam through a given angle varies to a considerable extent (usually in a ratio of 5) as a function of the degree of filling and therefore of the diameter of said warp beam. Since the speed of take-up of warp threads by the loom remains substantially constant, it is essential to control the rate of warp release from the warp beam in dependence on the diameter of said beam.

Furthermore, the tension of the warp threads is set at a mean value but this tension varies on each side of said mean value, for example according to the position of the heddle frames. Finally, shrinkage of the fabric is a function of the weave construction.

For all the reasons given above, it is essential to interpose between the warp-beam let-off mechanism and its drive system a regulator which produces action on the speed of rotation of the warp beam in such a manner as to ensure that the tension of the warp threads remains substantially constant.

There already exists a considerable number of regulating devices of this type. In general principle, such devices all serve to control the speed of rotation of the warp beam in dependence on the tension of the warp threads. In these designs, a speed-changing unit is interposed between the warp-beam let-off mechanism and the drive provided by the main motor of the loom.

The speed-changing unit just mentioned is usually of the type consisting of a driving-belt between two pulleys each having a flange spacing which can be varied simultaneously and in opposite directions with respect to each other. A known practice consists in providing direct control of the pulley-flange spacing of the speed-changing unit by displacement of the balance constituted by the thread support which is balanced on the one hand by the warp tension and on the other hand by means of weights or compensating springs. In no event, however, must the effort required by this control system disturb the equilibrium of said balance; this is not possible if it is sought to obtain a short response time. The response time provided by this system is too long, unless the speed of rotation of the pulley flanges is increased to a high value, thus making it necessary to adjust their speed of rotation to each new article to be woven, the adjustment being performed by means of a tangent plate or any suitable gear system.

U.S. Pat. No. 4,058,143 describes a system which removes the drawbacks noted above by means of a device comprising two stages: a so-called integration stage followed by a so-called proportional adjustment stage. The complexity of this system considerably increases its cost price and reduces its reliability.

In a French patent application No. 81/01438 filed on Jan. 27, 1981 now French Pat. No. 2498641, the present Applicant described a mode of regulation in which the variations in tension are pre-set between two fixed limits with low-amplitude, long-period pumping which does not impart any instability to the tension of the warp threads. However, this system is efficient only if the difference in tension with respect to the nominal value is of a low order (±5%). This means in particular that, at the moment of replacement of an empty warp beam by a full warp beam, the flange spacing of the variable pulleys must be adjusted by hand to the desired value since the correction time would otherwise be excessively long.

The object of the present invention is to overcome the disadvantages of known devices and to provide a servosystem for controlling the displacement of the movable flanges of a pulley-type speed-changing unit, said servosystem being actuated rapidly and without effort by the balance, the necessary power being drawn from the weaving loom itself by means of a mechanical device.

The invention is directed to an assisted mechanical control device for actuating a controlled element in accordance with the displacements of a movable sensing element, especially in order to actuate the regulating element of the speed-changing unit of a warp-beam let-off motion of a weaving loom in accordance with the displacements of the balance for measuring the tension of the warp threads. The control device comprises:

- a bar of substantial length which is displaced in reciprocating motion substantially in the direction of its length by means of a driving power source;
- a jamming member adapted to slide and to be selectively jammed against said bar according to the position of said member with respect to said bar;
- a first coupling system for connecting the sensing element to said jamming member in order to modify the position of said member with respect to said bar as a function of the displacements of the sensor;
- and a second coupling system for connecting said jamming member to the controlled element, the driving power required for displacement of said controlled element being supplied by said driving power source.

In the event that the invention is applied to a weaving loom, the driving power source aforesaid is provided by the main motor of the weaving loom.

In a preferred embodiment, the bar aforesaid is a rectilinear member which is driven in a reciprocating movement directed substantially along the length of said bar, the jamming member being pierced by an opening in which the bar is inserted. The dimensions of said opening are such that the jamming member is capable of sliding along or jamming against the bar according to the orientation given to the jamming member by the sensor.

The invention is also directed to a weaving loom equipped with a jamming control device for regulating the tension of warp threads.

These and other features of the invention will be more apparent to those skilled in the art upon consideration of the following description and accompanying drawings, wherein:

FIGS. 3 and 4 show a mode of balancing of the thread-supporting balance;

FIG. 5 is a detail of FIG. 3;

Figure 2:
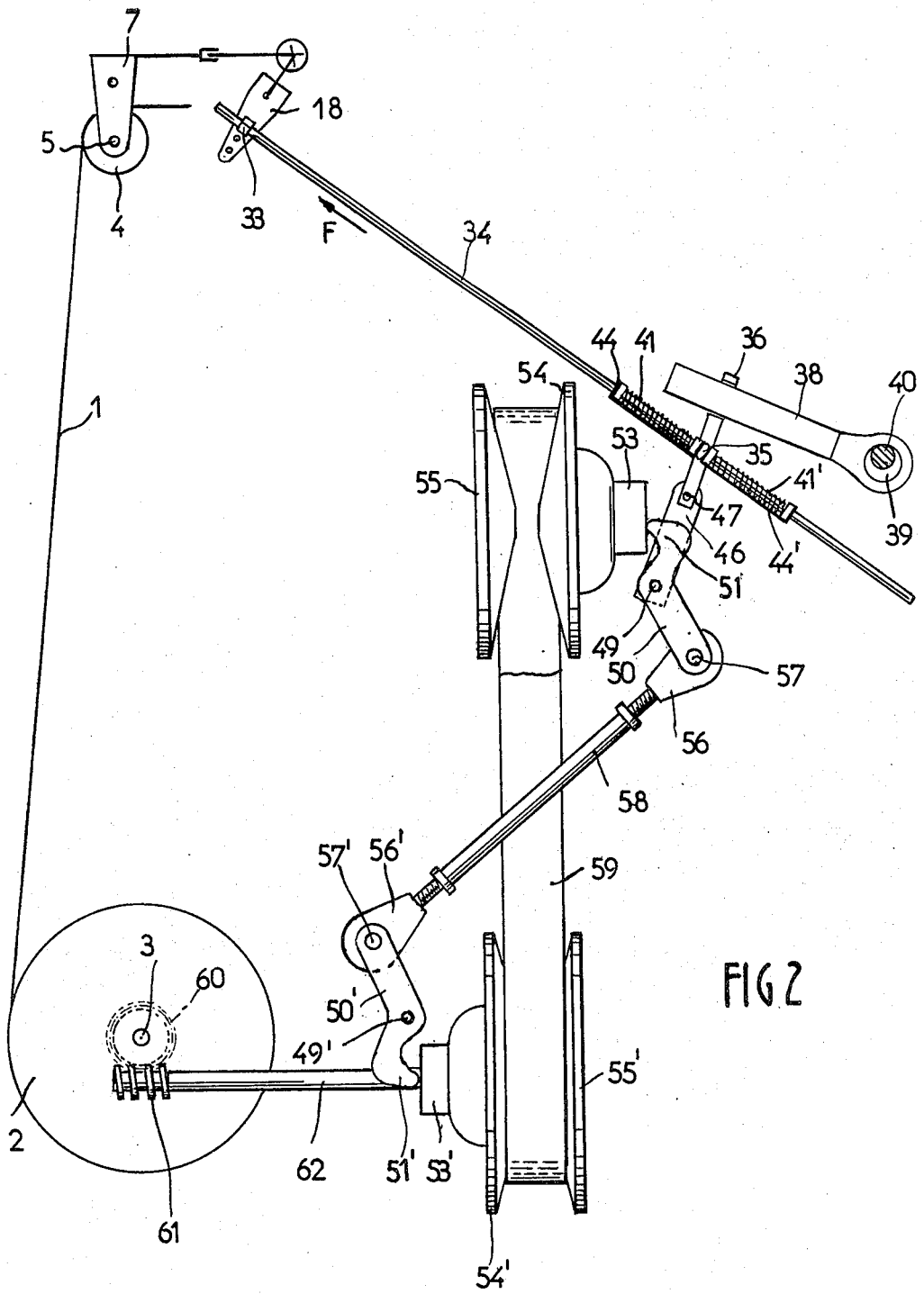
FIG. 2 is a general view of a device in accordance with the invention.

The warp threads 1 are wound side by side on a warp beam 2 which is rotatably mounted on a spindle 3 (as shown in FIG. 2) in order to carry out positive unwinding of the warp threads 1. Said warp threads are carried by a thread-supporting roller 4 before dividing into two layers in known manner so as to form the shed (not shown) of a weaving loom.

Figure 4:
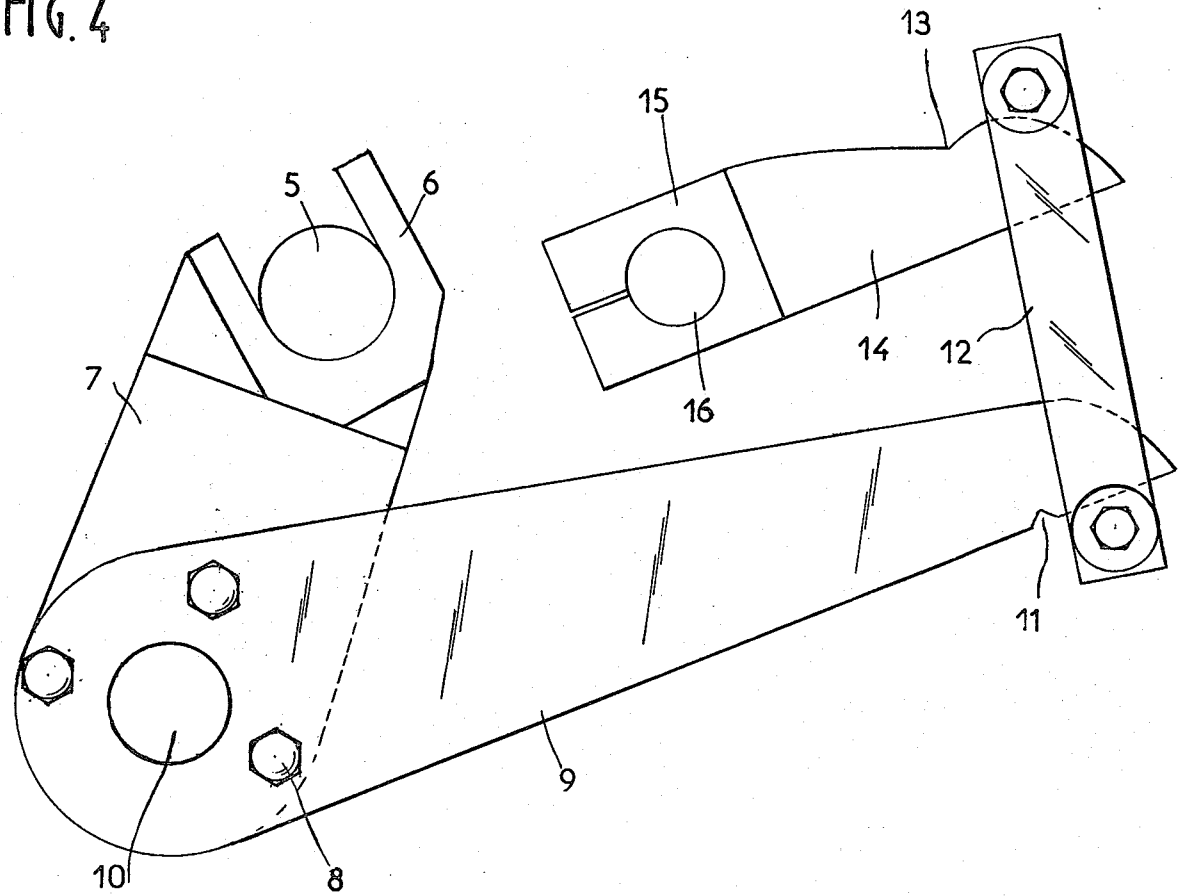

The spindle 5 of the thread-supporting roller 4 rests at each end in a bearing 6 which is rigidly fixed to an arm 7 (as shown in FIG. 4). Said arm 7 is attached by means of bolts 8, for example, to an arm 9 so as to form with this latter an elbowed lever which is pivotally mounted on a shaft 10. There is formed in the arm 9 a substantially triangular notch 11 which rests on a knife-edge during operation, said knife-edge being held in position within a yoke 12. Provision is made at the other end of said yoke 12 for a second knife-edge in cooperating relation with the notch 13 formed in the lever 14 which terminates in the bearing 15. In FIG. 4, the members 9 and 14 are shown as partly withdrawn from the yoke 12 in order to provide a clearer illustration of their shapes.

An assembly of the type shown in FIG. 4 is mounted on each side of the weaving loom. In addition to the spindle 5 of the thread-supporting roller 4, a shaft 16 fixed in the bearings 15 extends across the entire width of the loom.

As shown in FIG. 3, a toothed rack 17 and an arm 18 are keyed on the shaft 16 and are independent of each other. The toothed rack 17 passes within a yoke 19 so that one of the recessed portions 20 of the set of teeth of the toothed rack 17 is adapted to cooperate with a ridge 21 of a member 22 (FIG. 5) which is maintained transversely at 23 within the interior of the yoke 19. The two sides of the yoke 19 are joined together at 24 in a solid end portion in which is screwed a member 25, one end of a spring 26 being attached to said member 25. A member 25′ which is identical to the member 25 is adapted to carry the other end of the spring 26.

A threaded rod 27 passes through a bore of a member 28 which is rigidly fixed to the frame of the weaving loom. The threaded rod 27 and the clamping nuts 29, 29′ serve to adjust the extension of the spring 26. A double-acting hydraulic shock-absorber 30 is attached at one end at 31 to the toothed rack 17 and at the other end at 32 to the frame of the loom and therefore in parallel with the spring 26.

The assembly which has just been described constitutes the balance for measuring the tension of the warp threads and the arm 18 constitutes the movable sensing element, the position of which is representative of the tension of the warp threads.

Figure 8:
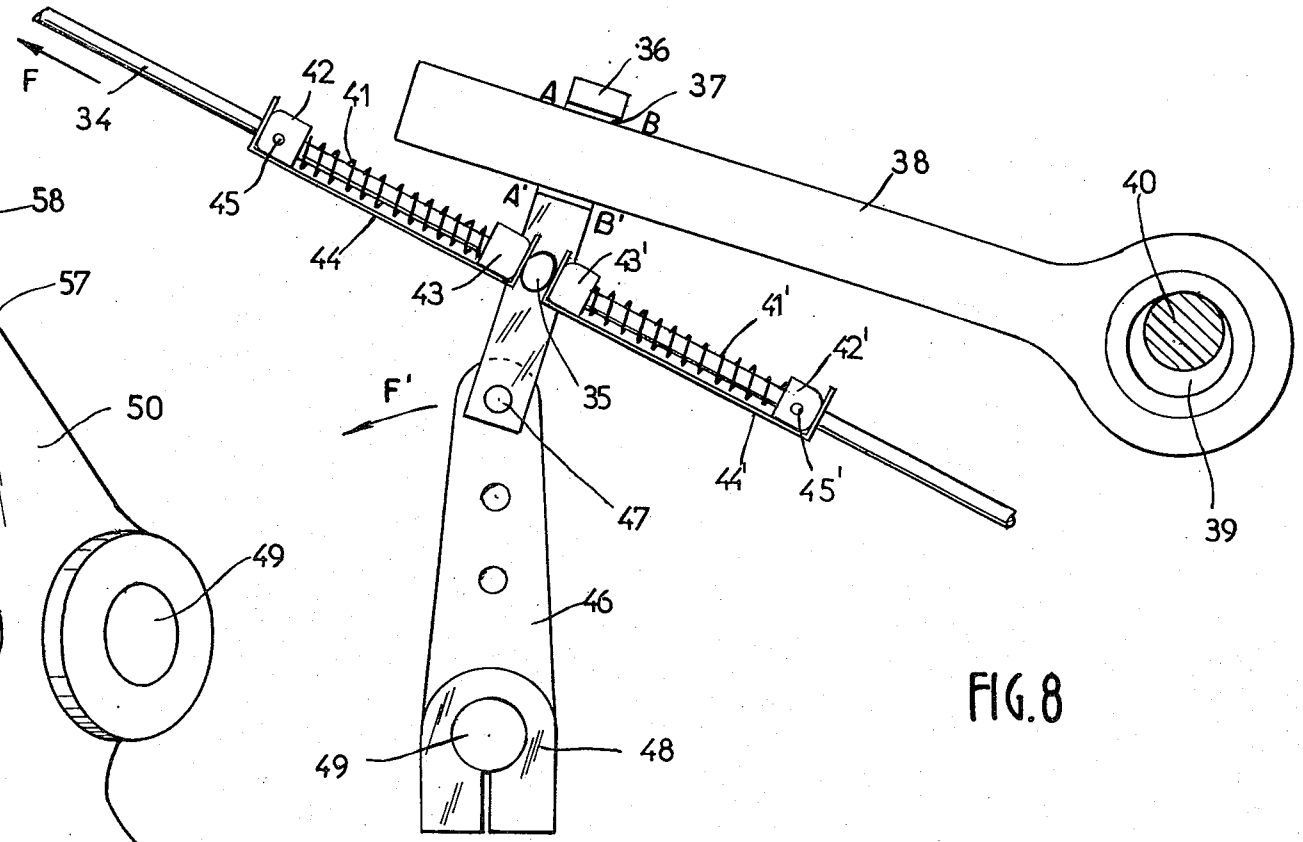
FIG. 8 illustrates the arrangement adopted for providing the power required to produce a displacement of the variable flange of the pulley.

A member 33 is attached to the arm 18 and a rod 34 is locked within said member. The rod 34 is also capable of sliding within a member 35 carried by a jamming member 36 as shown in FIG. 8. A bar 38 is adapted to pass within the bore 37 of said jamming member and is driven in reciprocating motion under the action of an eccentric 39 which is driven in rotation by a driving shaft 40. Said shaft is connected in known manner (not shown in the drawings) to the loom drive unit and rotates either at the beating-up speed of the loom or at a fraction of this speed (½, for example).

Figure 7:
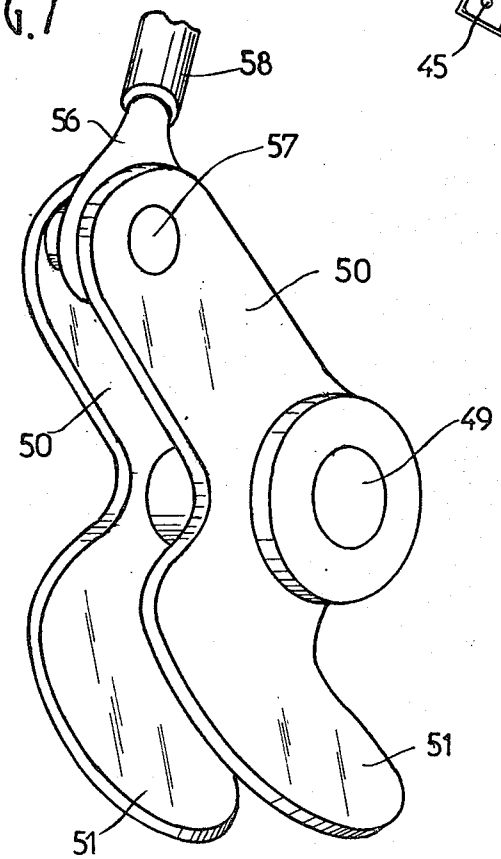
FIG. 7 illustrates the member for controlling the flange of the variable pulley.

On each side of the member 35, the rod 34 is surrounded by a spring 41, 41′. These springs are maintained compressed between two buffers 42, 42′ and 43, 43′ which occupy respectively the ends of two cradles 44, 44′. The buffers 42 and 42′ are secured to the rod 34 at 45, 45′, by means of locking-pins. An arm 46 is pivotally attached at 47 to the free end of the jamming member 36. The arm 46 terminates in a bearing 48 which embraces a shaft 49 and this latter passes through a member shown in FIG. 7. Said member is provided with a yoke 50, each arm of which extends beyond the shaft 49 so as to form a claw 51. The end of each claw 51 is capable of bearing on the edge of the hub 53 of the movable flange 54 of a variable-spacing pulley 55 (as shown in FIG. 2).

The yoke 50 grips an eyelet 56 and is rigidly fixed to this latter by means of a pin 57. In addition, the eyelet 56 is adjustably attached to the end of a rod 58, the other end of which is similarly adapted to carry an identical eyelet 56′ which is maintained within a yoke 50′ by means of a pin 57′. The yoke 50′ forms part of a unit which is pivotally mounted on a shaft 49′, the second arm of which is constituted by the pair of claws 51′ which are capable of coming into contact with the edges of the hub 53′ of the movable flange 54′ of the pulley 55′. The pulleys 55, 55′ are coupled by means of the driving-belt 59. The pulley 55′ drives the warp beam 2 in rotation about its spindle 3 by means of the toothed wheel 60 and the endless screw 61 carried by the shaft 62.

The entire assembly described in the foregoing constitutes the speed-changing unit of the warp-beam let-off motion whilst the claws 51, 51′ constitute the regulating elements of the speed-changing unit.

Figure 6:
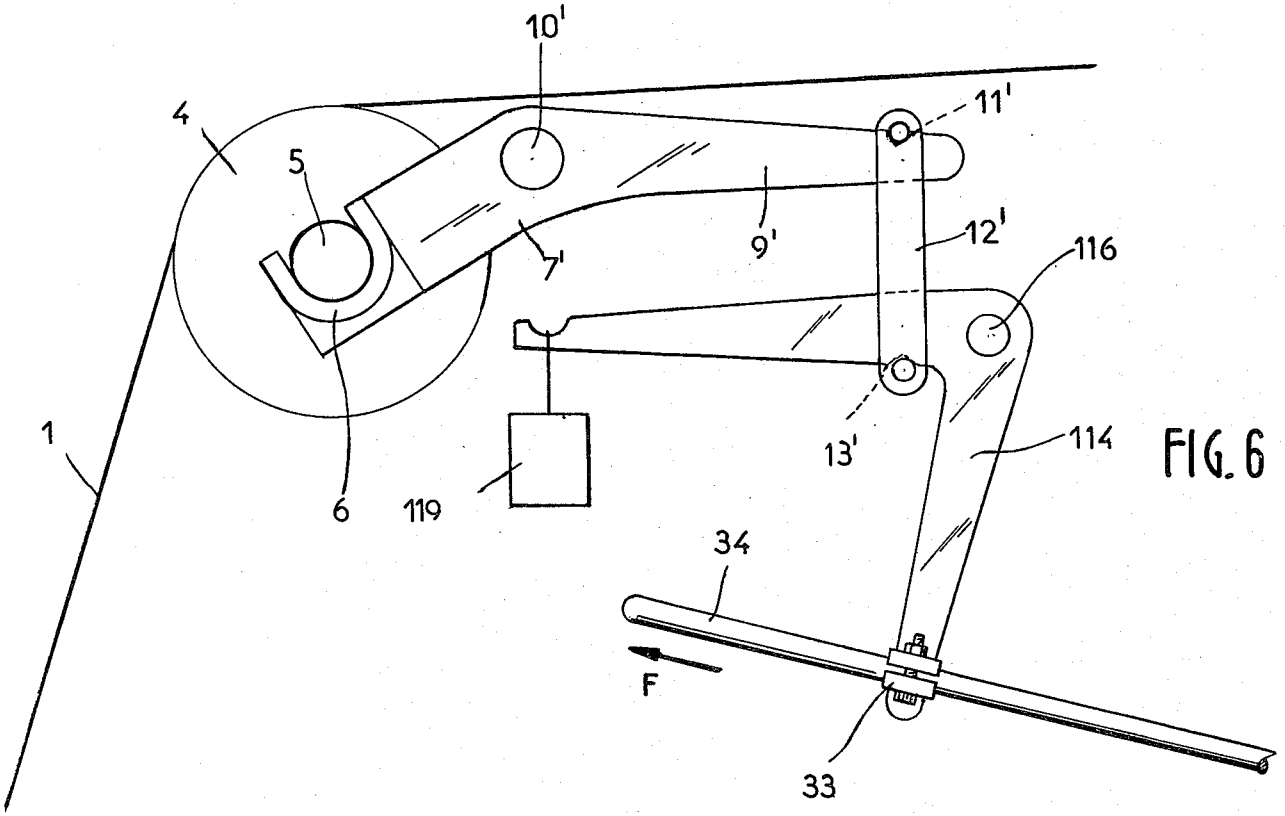
FIG. 6 illustrates another mode of balancing of the thread-supporting balance.

An alternative form of balance for measuring the tension of the warp threads is illustrated in FIG. 6. There is again shown at 7', 9' the elbowed lever constituted by the two arms 7, 9 of FIG. 4. The arm 14 is replaced by a second elbowed lever 114 which is pivotally mounted on a fulcrum-pin 116. One end of said lever is adapted to carry a weight 119 and the other end is fitted with the member 33 in which the rod 34 is fixed.

Figure 1:
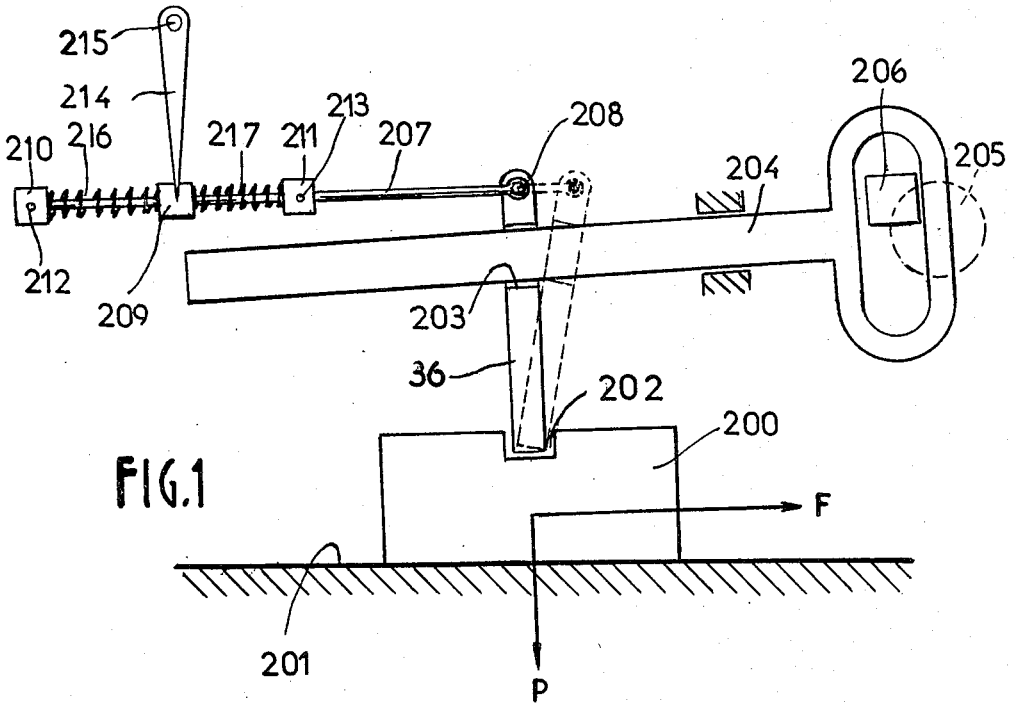
FIG. 1 is a general arrangement diagram of the invention.

In order to understand the operation of the device, consideration will first be given to FIG. 1 which is a simplified representation of the device in accordance with the invention. A gravity block 200 having a weight P is intended to be displaced by sliding motion on the plane surface 201 in the direction F. A jamming member 36 is pivotally mounted on said block 200 at 202 and has a bore 203 within which the bar 204 is adapted to pass with play, said bar being driven in reciprocating motion in the direction of its length under the action of a motor 205 and an eccentric 206. A rod 207 is attached to the member 36 at 208 and slidably mounted in the member 209. On each side of said member 209, the rod 207 is surrounded by springs 216, 217 compressed respectively between the buffers 209, 210 and 211, 209. The buffers 210 and 211 are attached to the rod 207 by means of locking-pins, respectively at 212 and 213. Under the action of a force of unprescribed value, the sensing element 214 is capable of oscillating about the pivot-pin 215, thus compressing one of the springs 216 or 217. If the displacement of the sensing element 214 is such that the spring 217 is subjected to compression, the rod 207 accordingly thrusts-back the member 36 which then takes up the position indicated in dashed outline in FIG. 1 and jams against the bar 204. The energy supplied by the motor 205 no longer has the sole function of imparting a reciprocating movement to the bar 204 but now serves to generate the force F which produces the displacement of the gravity block 200. This displacement stops when the block 200 has been brought to a position in which jamming of the member 36 against the bar 204 is suppressed or when the sensing element 214 gives a contrary order.

Consideration will now be given to the operation of the device shown in FIGS. 2, 3 and 8.

Postulating that the tension of the warp threads 1 has increased because the diameter of the warp beam has decreased at the moment when the tension of the warp threads 1 can no longer be balanced by the force of the spring 26, the spring expands and the toothed rack 17 undergoes a displacement towards the right (as shown in FIG. 3), thus driving the shaft 16 in rotation. Said shaft in turn displaces the arm 18 in the direction of the arrow 18'. The rod 34 moves in the direction of the arrow F, thus displacing the spring 41 within its cradle 44 without subjecting it to further compression (as shown in FIG. 8). The cradle 44' is applied against the member 35 under the compression of the spring 41'. The force exerted by the spring 41' is finally sufficient to cause the jamming member 36 to rotate towards the left and is jammed against the bar 38 (at A and B') within the bore 37. The energy supplied by the eccentric 39 can no longer impart its reciprocating motion solely to the bar 38 but displaces the entire system consisting of the jamming member 36, the bar 38, the pivot-pin 47 and the arm 46, said pin and arm being displaced in the direction of the arrow F'.

The result thereby achieved is a movement of rotation of the shaft 49 (shown in FIG. 2) which displaces the arm 50 in the anticlockwise direction and therefore the claws 51 in an anticlockwise movement of rotation, which has the effect of applying said claws against the hub 53 of the movable flange 54 of the pulley 55. At the same time, the movement of the arm 50 exerts a tractive force on the rod 58, thereby producing a pivotal movement of the arm 50' and the claws 51' in the clockwise direction. The claws 51' move away from the hub 53' of the movable flange 54' of the pulley 55'. The driving-belt 59 moves upwards while still remaining in contact with the flanges of the pulleys 55 and 55' by virtue of its compressibility. The linear speed of the driving-belt increases and this latter drives the shaft 62 at a higher speed, with the result that the speed of rotation of the warp beam about its spindle 3 increases; the rate of release of the warp threads increases and their tension decreases.

In the case of FIG. 6, when the tension of the warp threads exceeds the weight of the suspended block 119, said block returns upwards. The elbowed lever 114 undergoes a pivotal movement about the fulcrum-pin 116 and displaces the rod 34 in the direction of the arrow F. The result is the same as in the case of FIG. 3. When the tension of the warp threads has been restored to its nominal value, the system reverts to its initial configuration.

Should any slackening of the warp threads 1 take place, the spindle 5 of the thread-supporting roller 4 tends to move upwards with respect to its bearing 6. The spring 26 is compressed (as shown in FIG. 3) or the suspended block 119 moves downwards (FIG. 6). In both cases, the rod 34 moves in a direction opposite to the arrow F and is accompanied in its translational motion by the spring 41' without subjecting this latter to any further compression within its cradle 44' (as shown in FIG. 8) whilst the spring 41 is compressed and applies the cradle 44 against the member 35. Under the action of the force thus developed, the jamming member 36 undergoes a pivotal displacement towards the right and is jammed against the bar 38 at B and A'. The energy supplied by the eccentric 39 causes the arm 46 to pivot in the clockwise direction (as shown in FIG. 2). The shaft 49 rotates in the same direction, thus moving the claws 51 away from the hub 53. At the same time, the arm 50 exerts a thrust on the rod 58 which applies the claws 51' against the hub 53'. The driving-belt 59 moves downwards; its linear speed decreases and the warp beam 2 rotates at a lower speed. The rate of release of the warp threads decreases and their tension increases to its nominal value.

Figure 10:
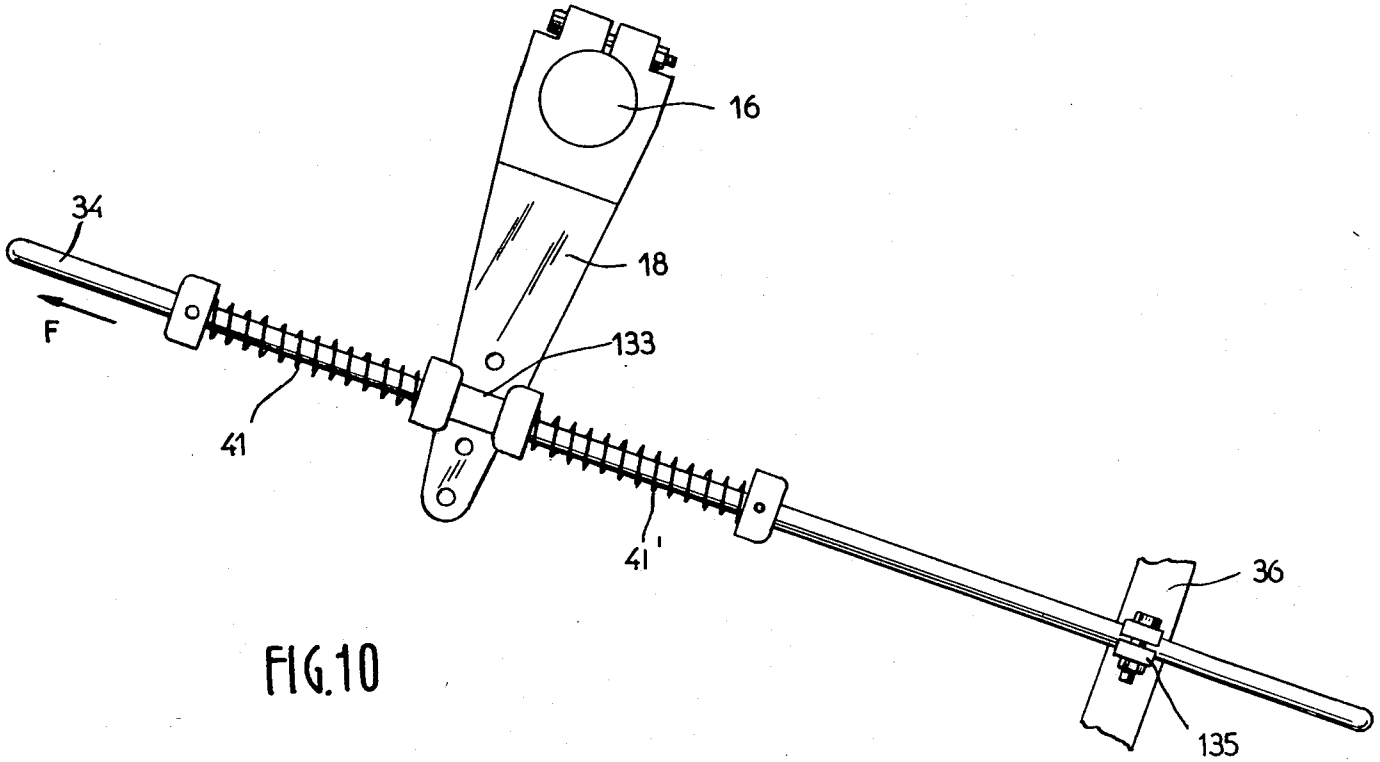
FIG. 10 illustrates an alternative form of the coupling system which provides a connection between the sensor and the jamming member.

Without departing from the scope of the invention, the device can be designed in accordance with FIG. 10. The rod 34 shown in this figure slides within the member 133 which is secured to the arm 18 and rigidly fixed to the bar 36 by means of the member 135. The springs 41 and 41' surround the rod 34 on each side of the member 133. When the shaft 16 rotates, for example in the clockwise direction, the arm 18 undergoes a displacement in the same direction. It compresses the spring 41 which thrusts the rod 34 in the direction of the arrow F. During its movement of displacement, the rod 34 exerts a tractive force on the member 36 which rotates about the pivot-pin 47 in the clockwise direction and jams against the bar 38 at A and B'. The process then continues in the manner described in the foregoing.

In yet another alternative design of the coupling between the arm 18 and the jamming member 36, the springs 41, 41' can be suppressed although this more simple solution does not have the same flexibility of operation as those described earlier. It is preferable in this case to make use of the rod 34 in order to provide a dead range of travel in the coupling between the arm 18 and the jamming member 36.

Figure 9:
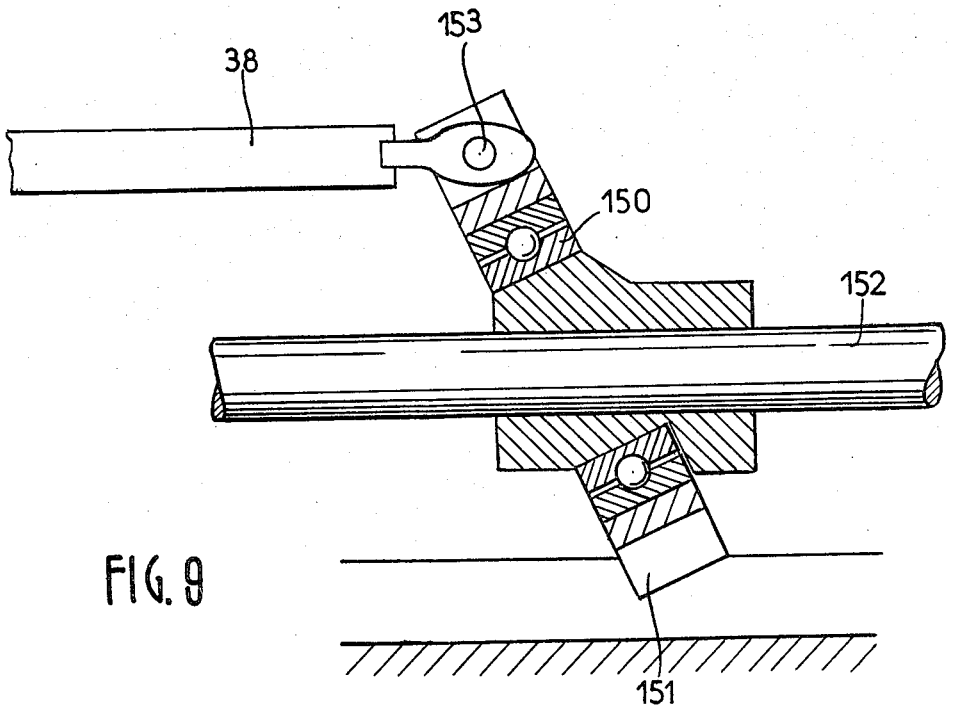
FIG. 9 is an alternative form of FIG. 8.

The reciprocating movement of the bar 38 may be produced by means other than an eccentric 39, for example by means of a member which produces a swash-plate movement. FIG. 9 shows one example of this solution. The bar 38 is rigidly fixed to a ball-bearing 150, the outer ring of which is secured against rotation at 151. Said ball-bearing 150 is driven by a motor (not shown in the figure) via the shaft 152. A swash-plate movement is produced at 153 and imparts a reciprocating movement to the bar 38.

A cam which is driven in rotation by the weaving loom and coupled to the bar 38 by any known means would produce the same result.

Finally, the attachment of the member 35 to the jamming member 36 is shown beneath the bar 38 but could also be placed above this latter without thereby departing from the scope of the invention.

Throughout the foregoing specification, the bar 38 has been described and illustrated in the form of a rectilinear member of substantial length such as, for example, a flat bar or a tube having a circular cross-section and driven in a reciprocating movement which is directed substantially along the length of the bar or the principal component of which is directed in the longitudinal direction. The jamming member 36 has also been described in the foregoing as being pierced by an opening such as a circular bore, for example, which is passed over the bar 38 with a clearance such that the member 36 may be selectively caused to slide along or jam against the bar 38, depending on the orientation of the member 36 with respect to said bar 38.

Figure 11:
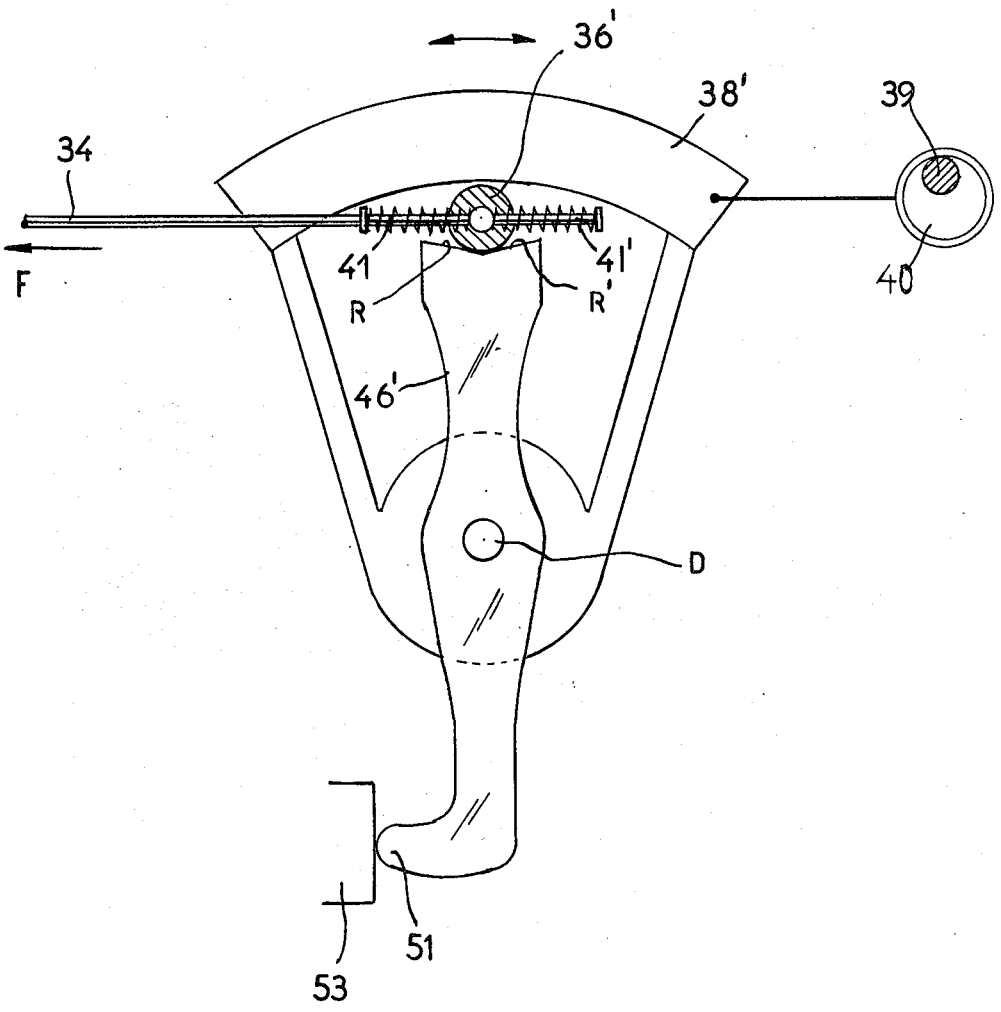
FIG. 11 is a schematic illustration of a device which makes use of an arcuate bar.

As shown in FIG. 11 and without departing from the scope of the invention, however, the bar of substantial length may consist of an arcuate bar 38' which is driven in a circular reciprocating movement about its center D by means of a cam and eccentric mechanism 38, 40.

The jamming member 36' is adapted to slide and to jam selectively against the bar 38', depending on its position with respect to said bar. The jamming member can be constituted by a roller 36' which is coupled to the rod 34, a certain degree of freedom of movement of the roller 36' with respect to the rod 34 being permitted by interposition of springs 41, 41'.

Depending on whether the roller 36' is displaced by the rod 34 in the direction of the arrow F or in the opposite direction, said roller is adapted to cooperate with a ramp R or with a ramp R' carried by an arm 46' which is also capable of pivotal displacement about the axis D.

The roller 36' is therefore capable of selective jamming against the bar 38' or of sliding against said bar. A coupling system is provided between the arm 46' and the claws 51 which produce action on the hub 53 of the movable flange of the pulley of the speed-changing unit. In the schematic representation of FIG. 11, this coupling is simply constituted by an extension of the arm 46'. The operation of the device is identical with the operation described earlier in connection with a rectilinear bar and therefore need not be discussed further.

Although consideration has been more particularly given in the foregoing to the application of the invention which consists in regulating the tension of warp threads in a weaving loom, it remains apparent that the device in accordance with the invention may also be applied to other machines in which an assisted mechanical control has to be provided for actuating a controlled element by means of the displacements of a movable sensing element, the driving power being supplied by a suitable power source and especially the main motor of the machine.

What is claimed is:

1. An assisted mechanical control device for actuating a controlled element in dependence on the displacements of a movable sensing element, especially in order to actuate the regulating element of the speed-changing unit of a warp-beam let-off motion of a weaving loom in accordance with the displacements of the balance for measuring the tension of the warp threads, wherein said device comprises:

a bar of substantial length which is displaced in reciprocating motion substantially in the direction of its length by means of a driving power source;

a jamming member adapted to slide and to be selectively jammed against said bar according to the position of said member with respect to said bar;

a first coupling system for connecting the sensing element to said jamming member in order to modify the position of said member with respect to said bar as a function of the displacements of the sensing element;

and a second coupling system for connecting said jamming member to the controlled element, the driving power required for displacement of said controlled element being supplied by said driving power source.

2. A device according to claim 1, wherein the bar aforesaid is a rectilinear member and wherein the jamming member is pierced by an opening in which said bar is engaged with play so that said jamming member is thus capable of sliding or of jamming against the bar according to the orientation of said jamming member with respect to said bar.

3. A device according to claim 1, wherein the bar aforesaid has an arcuate shape and is driven in a circular reciprocating movement and wherein the jamming member is capable of sliding or selectively jamming against one of the curved surfaces of said bar.

4. A device according to claim 1, wherein the first coupling system comprises a rod interposed between the sensing element and the jamming member, said rod being mounted for sliding motion over a limited range of travel with respect to at least one of the components consisting of said sensing element and said jamming member in order to ensure a dead-travel coupling between said sensing element and said jamming member.

5. A device according to claim 1, wherein the first coupling system comprises resilient connecting means which serve to transmit the displacements of the sensing element to the jamming member.

6. A device according to claim 4, wherein the first coupling system further comprises:

an intermediate member carried by one of said jamming member and said sensing element;

said rob being mounted for free longitudinal sliding movement through said intermediate member and operatively connected to the other of said jamming member and said sensing element;

a first buffer secured to said rod on one side of said intermediate member;

a second buffer secured to said rod on the other side of said intermediate member; and two springs coiled around said rod between said intermediate member and said buffers.

7. A device according to claim 6, wherein the springs are housed respectively within cradles.

8. A device according to claim 2, wherein the jamming member is pivotally attached by means of a pivot-pin to a lever which forms part of the second coupling system.

9. A device according to claim 1 for regulating the tension of warp threads in a weaving loom, wherein the sensing element forms part of the balance for measuring the tension of warp threads and wherein the aforementioned power source which serves to drive the bar is provided by the main motor of the weaving loom.

10. A device according to claim 9, wherein the controlled element produces action on a belt-driven speed-changing unit for controlling the warp-beam let-off motion of the weaving loom.

11. A device according to claim 9, wherein the bar is driven in reciprocating motion.

12. A device according to claim 11, wherein the reciprocating motion is produced by an eccentric.

13. A device according to claim 11, wherein the reciprocating motion is produced by an oblique ball-bearing in a swash-plate motion.

14. A device according to claim 11, wherein the reciprocating motion is produced by a cam.

15. A weaving loom, wherein said loom is equipped with a device for regulating the tension of warp threads according to claim 1.

* * * * *